US005085128A

United States Patent [19]

Nakamura et al.

[11] Patent Number: 5,085,128

[45] Date of Patent: Feb. 4, 1992

[54] VARIABLE DISPLACEMENT BENT AXIS TYPE HYDRAULIC MACHINE

[75] Inventors: Shigetaka Nakamura; Yasuharu Gotoh, both of Tsuchiura; Eiki Izumi, Ibaraki, all of Japan

[73] Assignee: Hitachi Construction Machinery Co., Ltd., Tokyo, Japan

[21] Appl. No.: 663,001

[22] Filed: Mar. 1, 1991

[51] Int. Cl.[5] ..... F01B 13/04

[52] U.S. Cl. ..... 91/504; 417/222

[58] Field of Search ..... 91/504, 505, 506, 499; 417/222 R, 269

[56] References Cited

U.S. PATENT DOCUMENTS

| | | | |
|---|---|---|---|
| 4,007,662 | 2/1977 | Deininger | 91/504 |
| 4,466,338 | 8/1984 | Stoelzer | 91/506 |
| 4,958,581 | 7/1984 | Paley | 91/506 |

*Primary Examiner*—Richard A. Bertsch
*Assistant Examiner*—Peter Korytnyk
*Attorney, Agent, or Firm*—Antonelli, Terry, Stout & Kraus

[57] ABSTRACT

Described herein is a variable displacement bent axis type hydraulic machine having a center shaft within a casing in a tilted state along with a valve plate and a cylinder block, and provided with a tilt angle sensor mechanism for detecting the tilt angle of the valve plate. For the purpose of improving the resolution in angle detection, the tilt angle sensor mechanism is constituted by a support shaft rotatably supported on a side wall of the casing at a position deviated toward the valve plate from the pivoting point of the center shaft, a rocking lever having one end thereof securely fixed to the support shaft and the other end pivotally supported at one side of the valve plate, and an angle sensor adapted to detect the rotational angle of the support shaft resulting from rocking movement of the rocking lever. This arrangement permits a wider rotational angle for the support shaft to guarantee higher resolution in the tilt angle detection.

3 Claims, 4 Drawing Sheets

VARIABLE DISPLACEMENT BENT AXIS TYPE HYDRAULIC MACHINE

BACK GROUND OF THE INVENTION

1. Field of the Invention

This invention relates to a variable displacement bent axis type hydraulic machine suitable for use as a hydraulic pump or motor on various machines including, for example, ground working machines, construction machines or the like.

2. Description of the Prior Art

Shown in FIGS. 1 and 2 is a bent axis type hydraulic pump as an example of conventional variable displacement bent axis type hydraulic machine. In these figures, the reference 1 denotes a casing of the motor, which is composed of a main casing 1A substantially of a cylindrical shape and a head casing 1B closing one end of the main casing 1A. Indicated at 2 is a rotational shaft which is projectingly provided within the main casing 1A and rotatably supported by bearings 3, 3, the rotational shaft 3 having a drive disc 2A integrally formed at the fore end thereof. Designated at 4 is a cylinder block which is located within the main casing 1A for rotation with the rotational shaft 2, and which has a plural number of cylinders 5 bored axially therein. Each cylinder 5 receives therein a reciprocating piston 6 which is securely fixed to a connecting rod 7. The connecting rod 7 is provided with a spherical portion 7A at the fore end thereof, which is rockably supported in the drive disc 2A.

The reference numeral 8 indicates a valve plate of a rectangular shape, one end face of which is held in sliding contact with the cylinder block 4 while the other end face of the valve plate 8 is held in sliding contact with a concavely arcuate tilt—sliding surface 9 which is formed on the head casing 1B and which has a pivoting point at $O_1$ as will be explained hereinafter.

The valve plate 8 is centrally provided with a bore 8A, receiving from the opposite sides thereof the end portions of a center shaft 12 and a rocking pin 17 which will be explained later. The valve plate 8 is further provided with oil ports 8B and 8C which are intermittently brought into communication with the respective cylinders 5 by rotation of the cylinder block 4. Irrespective of the tilting position of the valve plate 8, the oil ports 8B and 8C are communicated with oil passages 10 and 11 which are opened to the tilt—sliding surface 9 of the head casing 1B.

The center shaft 12 which supports the cylinder block 4 between the drive disc 2A and the valve plate 8 is formed with a spherical portion 12A at one end thereof, and pivotally supported in the drive disc 2A for rocking movement about the center $O_1$ of the spherical portion 12A. The other end of the center shaft 12 is fitted in the bore 8A of the valve plate 8.

Indicated at 13 is a sector type tilting mechanism which serves to tilt the valve plate 8 along the tilt—sliding surface 9, the tilting mechanism 13 including a cylinder chamber 14 bored in the head casing 1B and having oil passages 14A and 14B at the opposite axial ends thereof, a servo piston 16 slidably received in the cylinder chamber 14 and defining oil chambers 15A and 15B at the opposite axial ends of the cylinder chamber 14, and the rocking pin 17 fitted in an intermediate portion of the servo piston 16 perpendicularly to the axis of the latter and having a spherical fore end portion 17A rockably fitted in the bore 8A of the valve plate 8. As oil pressure is fed to and from the oil chambers 15A and 15B, the valve plate 8 and the cylinder block 4 are integrally tilted along the tilt—sliding surface 9.

Designated at 18 is a tilt angle sensor mechanism which is arranged to detect the tilt angle of the valve plate 8 and which includes: a boss portion 19 which is projected at one side of the casing 1A in a predetermined positional relationship as will be described hereinafter; a support shaft 21 fitted in the boss portion 19 and rotatably supported on the main casing 1A through a bearing 20; a rocking lever 23 located along one side of the cylinder block 4 within the main casing 1 and having one end thereof securely fixed to the support shaft 21 through a pin 22 and the other end thereof extended to one side of the valve plate 8; a support pin 24 planted on one side of the valve plate 8 and fitted in the other end of the rocking lever 23; and an angle sensor 26 mounted on the outer end face of the boss portion 19 in a liquid tight fashion by use of an O-ring (not shown) and coupled with the support shaft 21 through a coupling 25. For example, a potentiometer can be employed as the angle sensor 26.

In this instance, expressing by A—A the line of axis of the rotational shaft 2, by $O_1$ the pivoting point of the spherical portion 12A of the center shaft 12, by B—B the line of vertical axis perpendicularly intersecting the line of axis A—A and by B'—B' the line of horizontal axis perpendicularly intersecting the line of axis A—A through the pivoting point $O_1$, the boss portion 19 and the support shaft 21 of the tilt angle sensor mechanism 18 are provided on the line of horizontal axis B'—B'.

In FIG. 1, the reference character $\theta$ denotes the tilt angle of the cylinder block 4 and the valve plate 8 with respect to the line of axis A—A.

The prior art hydraulic motor with the above-described construction operates in the following manner when employed as a hydraulic pump.

Firstly, together with the cylinder block 4, the valve plate 8 is turned into the tilted position shown, by the tilting machanism 13. For this purpose, for example, oil pressure from an auxiliary tilt control pump is supplied to the oil chamber 15A (or 15B) at one end of the cylinder chamber 14 through a control valve (not shown) to displace the servo piston 16. As a result, the rocking pin 17 is displaced together with the servo piston 16, causing the valve plate 8 to slide on and along the tilt—sliding surface 9 and as a consequence tilting the cylinder block 4 through the center shaft 12 until its axis of rotation is turned to a maximum tilt angle (or to a minimum tilt angle) with the axis of the rotational shaft 2. In FIG. 1, the cylinder block 4 is shown as being turned to a maximum tilt angle.

Nextly, the rotational shaft 2 is driven by actuating an engine, electric motor or other suitable drive source, whereupon the cylinder block 4 is rotated together with the rotational shaft 2 since the drive disc 2A on the rotational shaft 2 is coupled with the respective pistons 6 in the cylinders 5 of the cylinder block 4 through the connecting rods 7. As a result of the rotation of the cylinder block 4, the pistons 6 are reciprocated in the respective cylinders 5. When each piston 6 is moved out of the cylinder 5, namely, in the suction phase, the operating oil is drawn into the cylinder 5 through the oil passage 10 (11) and the oil port 8B (8C); and when the piston 6 is moved into the cylinder 5, namely, in the discharge phase, the operating oil is discharged from the cylinder 5 through the oil port 8C (8B) and the oil passage 11 (10).

Turning now to the detection of the tilt angle $\theta$, when the valve plate 8 is turned about the center $O_1$ of rocking movement as it is slided along the tilt—sliding surface 9, the support pin 24 which is provided at one side of the valve plate 8 is moved arcuately about the support shaft 21 together with the rocking lever 23 to turn the support shaft 21. The rotational angle of the support shaft 21 is detected by the angle sensor 26 through the coupling 25, measuring the tilt angle $\theta$ in terms of an electric amount.

In this manner, the variable displacement bent axis type hydraulic machine is arranged to obtain a necessary discharge rate through adjustment of the tilt angle $\theta$, by detecting the tilt angle $\theta$ of the valve plate with the tilt—sliding surface 9 and controlling the supply of oil pressure from a control valve to the tilting mechanism 13 in such a manner as to set a tilt angle at a value corresponding to the necessary discharge rate.

In this regard, in the above-described prior art device, the tilt angle sensor mechanism 18 for detecting the tilt angle $\theta$ of the valve plate 8 has the centers of the support shaft 21 and angle sensor 26 located on the line of horizontal axis B'—B'. Namely, the angle sensor 26 is arranged simply to copy the tilt angle $\theta$ of the valve plate 8. Therefore, in a case where the rotational angle of the valve plate 8 is relatively small as compared with the detection angle (the maximum detection angle) of the sensor 26, the resolution of the tilt angle $\theta$ becomes low. For example, in a case where the detection angle of the angle sensor 26 is 32° while the tilt angle of the valve plate 8 is 16°, only half of the resolution power of the angle sensor 26 is available, without ability of detecting the tilt angle $\theta$ accurately at fine levels. Further, when the bent axis type hydraulic machine is used as a pump, it is difficult to make fine adjustments of the discharge rate which require accurate detection of the tilt angle $\theta$. Besides, when applied as a motor, there arises a problem that fine adjustment of rotation of the rotational shaft 2 is impossible.

In view of the drawbacks or problems of the prior art as described above, the present invention has as its object the provision of a variable displacement bent axis type hydraulic machine which is provided with a tilt angle sensor mechanism with improved resolution power for the tilt angle detection.

SUMMARY OF THE INVENTION

In accordance with the present invention, there is provided, for achieving the above-stated objective, a variable displacement bent axis type hydraulic machine with a tilt angle sensor mechanism which is constituted by a support shaft rotatably supported on a side surface of the main casing at a position deviated from the pivoting point of the center shaft toward the valve plate, a rocking lever having one end thereof securely fixed to the support shaft and the other end supported at one side of the valve plate; and an angle sensor adapted to detect the rotational angle of the support shaft as resulting from the rocking movement of the rocking lever.

In this case, assuming that the valve plate has a minimum tilt angle $\alpha$, a maximum tilt angle $\beta$ and an intermediate tilt angle $\gamma(=(\alpha+\beta)/2)$ with respect to the line of axis A—A of the rotational shaft, the support shaft is provided on a side wall of the main casing of the hydraulic machine at a position located on a line drawn through the pivoting point of the center shaft at an angle of $\gamma$ with the line of axis A—A of the rotational shaft, and deviated from the pivoting point of the center shaft toward the valve plate.

Further, a slot is provided at the other end of the rocking lever to receive therein a support pin provided at one side of the valve plate.

With the above-described construction, it becomes possible to secure a large rotational angle of the support shaft, namely, a larger rotational angle of the angle sensor provided on the support shaft for the purpose of improving the resolution in detection of the tilt angle.

Besides, by providing the support shaft at the position of the intermediate tilt angle $\gamma$, it becomes possible to minimise the longitudinal variation of the rocking lever (variation in distance between the support shaft and the support pin) when it is rocked about the support shaft as a result of tilting of the valve plate. Furthermore, the slot provided at the other end of the rocking lever serves to absorb variations which would occur to the distance between the support shaft and the support pin as a result of tilting of the valve plate.

The above and other objects, features and advantages of the invention will become apparent from the following description and the appended claims, taken in conjunction with the accompanying drawings which show by way of example a preferred embodiment of the invention.

BEST MODE FOR CARRYING OUT THE INVENTION

Figure 1:
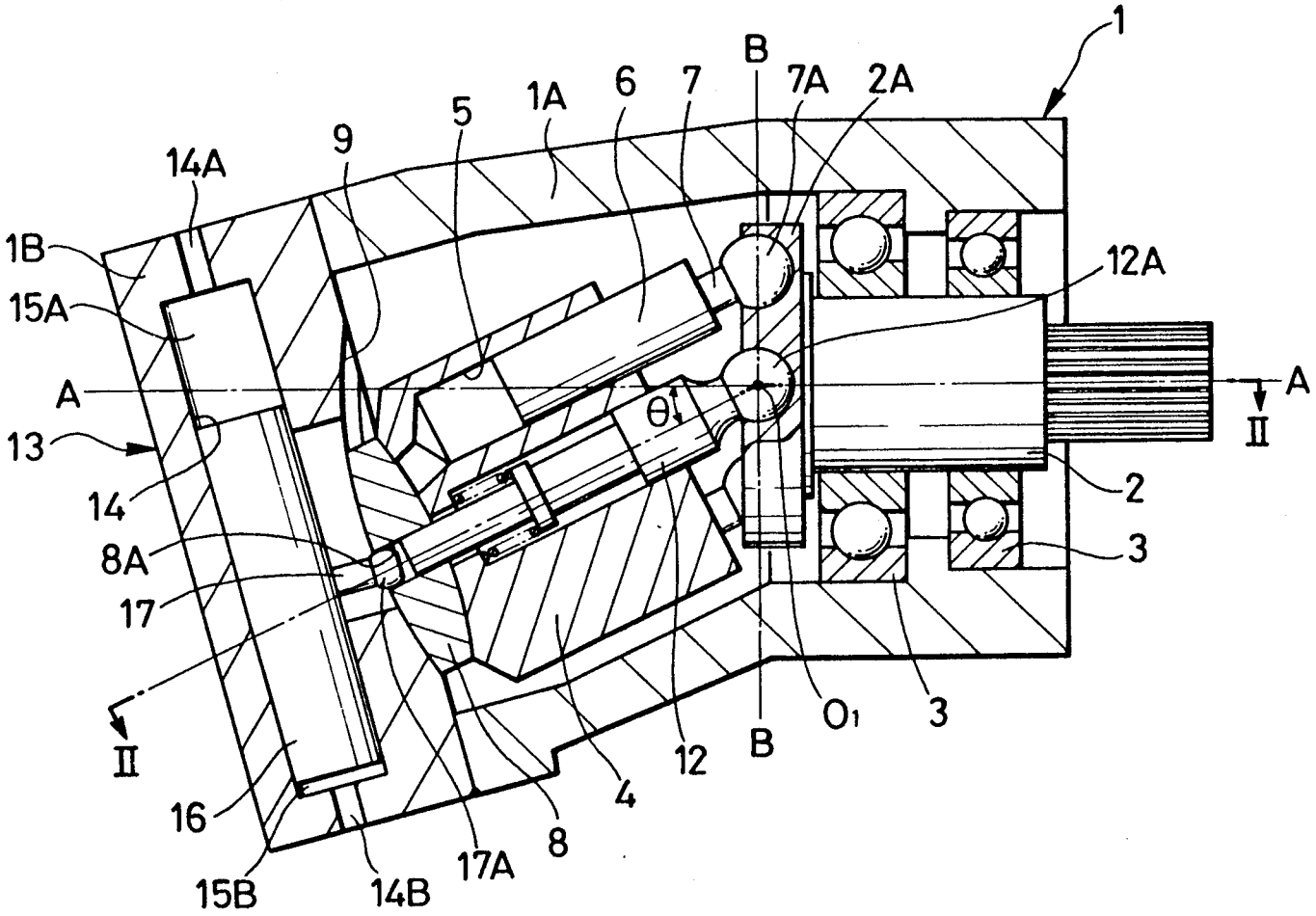
Fig. 1 PRIOR ART
FIG. 1 is a longitudinal section of a conventional hydraulic machine.
Figure 2:
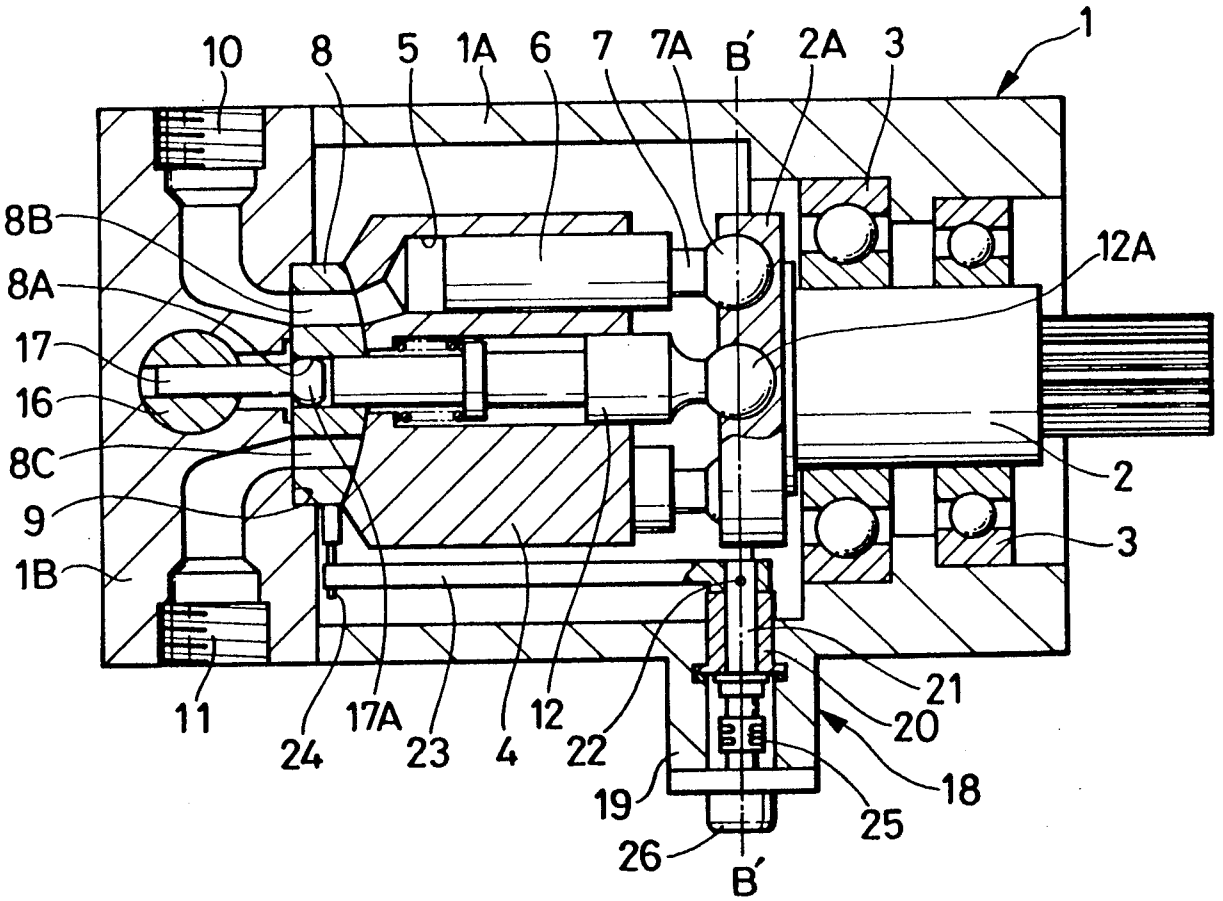
Fig. 2 PRIOR ART
FIG. 2 is a sectional view taken on line II—II of FIG. 1.
Figure 3:
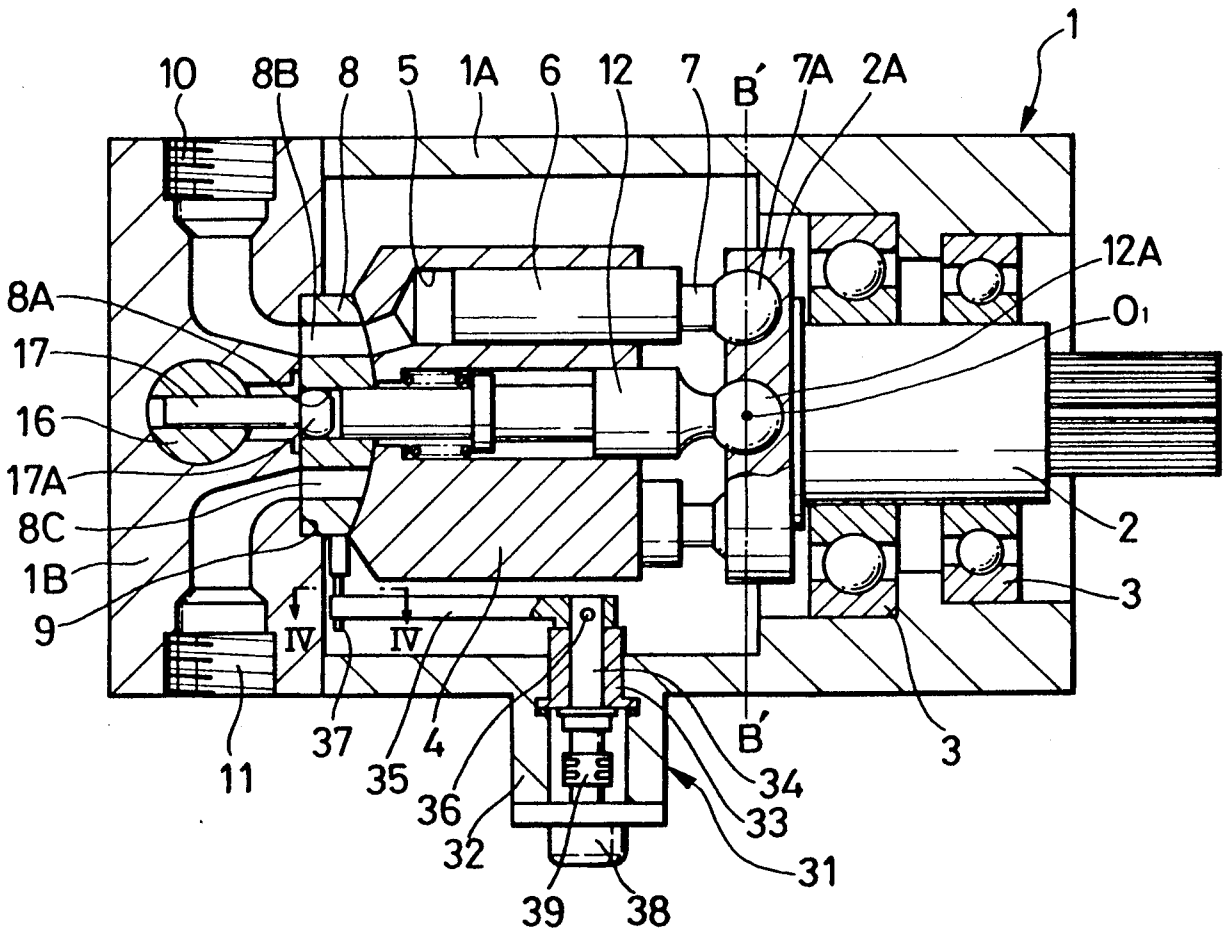
FIG. 3 is a view similar to FIG. 2 but showing an embodiment of the hydraulic machine of the invention at the position of the intermediate tilt angle.
Figure 4:
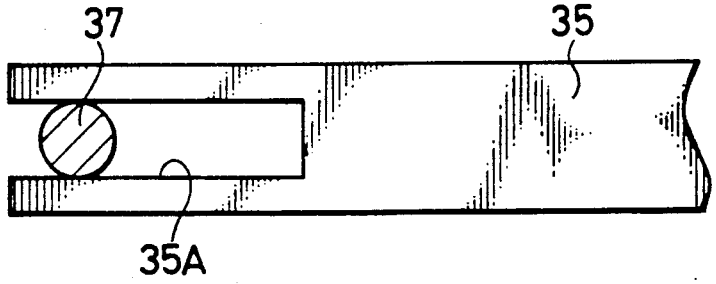
FIG. 4 is a fragmentary sectional view taken on line IV—IV of FIG. 3.

Hereafter, a preferred embodiment of the invention is described with reference to FIGS. 3 through 6, in which the component parts common to the prior art device are designated by common reference numerals or characters, and their description is ommited to avoid repetitions.

In the drawings, the reference 31 denotes a tilt angle sensor mechanism employed in the present embodiment, including a boss portion 32 which is projected from a side surface of the main casing 1A at a position which is appreciably deviated from the line of horizontal axis B'—B' toward the valve plate 8 as compared with the position of the boss portion 19 of the conventional hydraulic pump described hereinbefore. Received in the boss portion 32 is a support shaft 34 which is journalled on the main casing 1A through a bearing 33. Indicated at 35 is a rocking lever adopted in this embodiment, the rocking lever 35 being extended along one side of the cylinder block 4 and having one end thereof securely fixed to the support shaft 34 through a pin 36 and the other end pivotally connected to a support pin 37 planted on a side surface of the valve plate 8. The other end of the rocking lever 35 is bifurcated to provide a slot 35A as shown particularly in FIG. 4. That is, the rocking lever 35 is linked with the valve plate 8 through the support pin 37 which is planted on a side surface of the valve plate 8 and received in the slot 35A of the rocking lever 35. Indicated at 38 is an angle sensor which is fitted liquid-tight on the outer end face of the boss portion 32 through an O-ring (not shown) and in association with the support shaft 34 through a coupling 39. This angle sensor 38 is arranged to detect the tilt angle of the rocking lever 35 by way of the rotational angle of the support shaft 34.

Thus, the tilt angle sensor mechanism 31 of this embodiment is constituted by the boss portion 32, bearing 33, support shaft 34, rocking lever 35, pin 36, support pin 37, angle sensor 38 and coupling 39.

Figure 5:
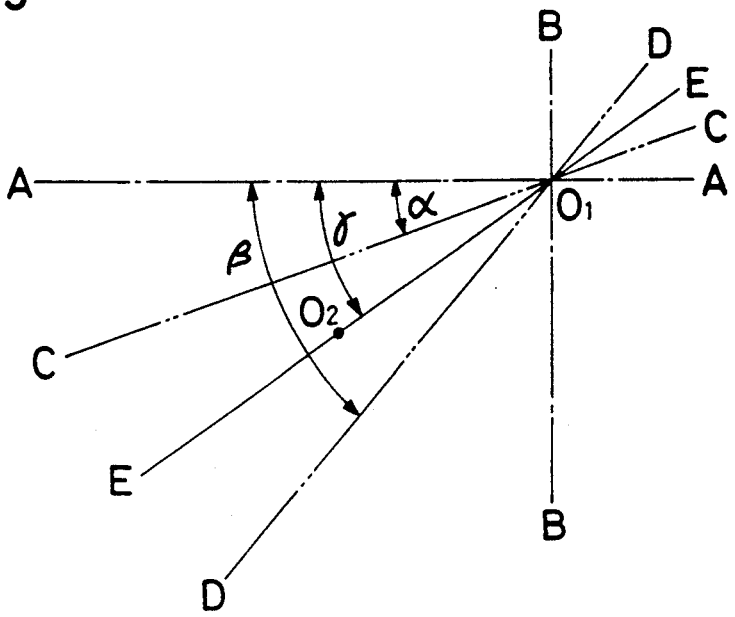
FIG. 5 is a diagrammatic illustration explanatory of the relationship of the minimum tilt angle $\alpha$ and the maximum tilt angle $\beta$ with the intermediate tilt angle $\gamma$.

The mounting position of the boss portion 32 is now explained with reference to FIG. 5. Expressing the minimum tilt angle of the cylinder block 4 and valve plate 8 with respect to the line of axis A—A of the rotational shaft 2 by $\alpha$, the line of axis through the pivoting point $O_1$ by C—C, the maximum tilt angle by $\beta$, the line of axis of the maximum tilt angle $\beta$ by D—D, the intermediate tilt angle between the minimum and maximum tilt angles $\alpha$ and $\beta$ by $\gamma$ $$\gamma=(\alpha+\beta)/2 \quad (1)$$

and the line of axis through the pivoting point $O_1$ at the intermediate tilt angle by E—E, the boss portion 32 is provided on a side surface of the main casing 1A at a position located on the line of axis E—E at the intermediate tilt angle and deviated from the pivoting point $O_1$ of the center shaft 12 toward the valve plate 8.

When used as a hydraulic pump, the hydraulic machine of this embodiment, with the above-described construction, barely differs from the conventional counterpart in the pumping operation itself.

Figure 6:
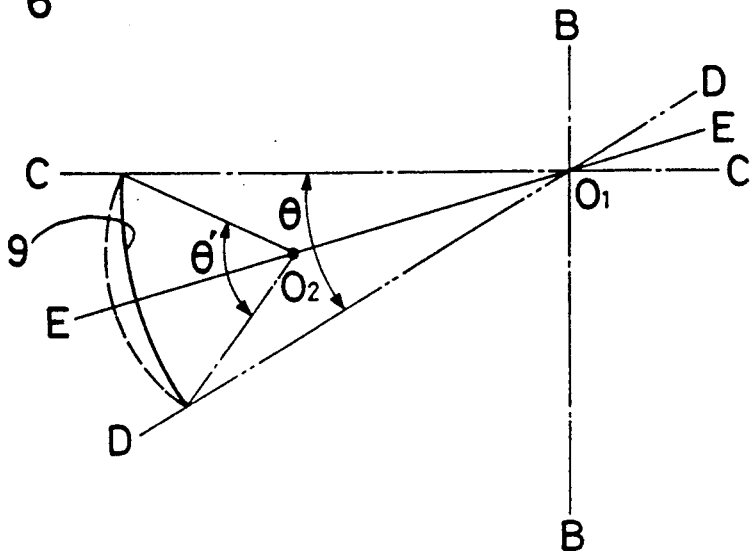
FIG. 6 is a diagrammatic illustration showing the detection angle of the present invention in comparison with that of the prior art counterpart.

More secifically, reference is now has to FIG. 6 to explain the differences from the conventional counterpart, which accrue from the arrangement of the invention in which the positions of the boss portion 32, support shaft 34 and angle sensor 38 of the tilt angle sensor mechanism 31 are deviated toward the valve plate 8 as compared with the prior art angle sensor 38.

In FIG. 6, the valve plate 8 is slided along the tilt-sliding surface 9 arcuately about the pivoting point $O_1$. In case of the prior art machine in which the boss portion 19 on the casing 1A is located at the pivoting point $O_1$, the support shaft 21 has the axis of its rotation also at $O_1$ with a rotational or detection angle $\theta$. In contrast, in the above-described embodiment of the invention, the boss portion 32 is located at an arbitrary position $O_2$ on the line of axis E—E at the intermediate tilt angle and between the valve plate 8 and the pivoting point $O_1$, so that the support shaft 34 has a wider rotational angle $\theta'$ as compared with the prior art counterpart. Consequently, the detection angle of the angle sensor 38 is broadened to improve its resolution power in detection of the tilt angle.

Besides, since the pivoting point $O_2$ of the rocking lever 35 is located on the line of axis E—E at the intermediate tilt angle in satisfaction of Equation (1), the fore end of the rocking lever 35 is moved along an arcuate locus as indicated by broken line in FIG. 6. As a result, when the valve plate 8 is tilted from the minimum tilt angle $\alpha$ to the maximum tilt angle $\beta$, the variation in the longitudinal direction of the rocking lever 35 (variation in distance between the support shaft 34 and the support pin 37) can be suppressed to a minimum.

Further, the longitudinal fluctuations of the rocking lever 35 or the fluctuations which occur to the distance between the support shaft 34 and the support pin 37 as a result of the tilting movement of the valve plate 8 can be suitably absorbed by fitting the support pin 37 in the slot 35A of the rocking lever 35 as mentioned hereinbefore.

As clear from the foregoing description, according to the present invention, the support shaft 34 can be turned through a broadened rotational angle $\theta'$ to secure a wider detection angle for the angle sensor 38. It follows that the tilt angle of the valve plate 8 with respect to the tilt-sliding surface 9 can be detected accurately, and fine adjustment of the control pressure to the tilting mechanism 13 becomes feasible, permitting to control the discharge rate accurately when the bent axis type hydraulic machine is used as a pump. On the other hand, when used as a motor, it becomes possible to control the rotation of the rotational shaft 2 with higher accuracy.

Although the tilting mechanism 13 is provided in the head casing 1B in the variable displacement bent axis type hydraulic machine of the foregoing embodiment, it may be provided in the main casing 1A if desired.

POSSIBILITIES OF INDUSTRIAL APPLICATION

It will be appreciated from the foregoing description that, according to the present invention, there is provided a tilt angle sensor mechanism having the support shaft rotatably supported on a side wall of the main casing in a position deviated toward the valve plate from the pivoting point of the center shaft, in combination with the rocking lever having one end thereof securely fixed to the support shaft and the other end pivotally supported at one side of the valve plate, securing a broader rotational angle for the support shaft and a wider detection angle for the angle sensor to enhance higher resolution in angle detection. Accordingly, the tilt angle of the valve plate can be detected with high accuracy, permitting accurate control of the discharge rate control of rotation of the rotational shaft when used as a motor.

What is claimed is:

1. A variable displacement bent axis type hydraulic machine including: a cylindrical casing provided with a head casing; a rotational shaft extended into said casing and formed with a drive disc at the inner end thereof: a cylinder block provided in said casing for rotation with said rotational shaft and axially bored with a plural number of cylinders; a plural number of pistons reciprocably received in the respective cylinders of said cylinder block and each having one end thereof pivotally supported on said drive disc; a valve plate having one end face thereof held in sliding contact with said cylinder block and being rockable at the other end face along a tilt-sliding surface on said head casing; a center shaft rotatably supporting said cylinder block between said valve plate and rotational shaft; and a tilt angle sensor mechanism adapted to detect the tilt angle of said valve plate with respect to said tilt-sliding surface;

characterized in that said tilt angle sensor mechanism comprises: a support shaft rotatably supported on a side wall of said casing at a position deviated toward said valve plate from the pivoting point of said center shaft; a rocking lever having one end thereof securely fixed to said support shaft and the other end pivotally supported at one side of said valve plate; and an angle sensor adapted to detect the rotational angle of said support shaft as caused by rocking movement of said rocking lever.

2. A variable displacement bent axis type hydraulic machine as defined in claim 1, wherein, expressing the minimum tilt angle of said valve plate by $\alpha$, the maximum tilt angle by $\beta$ and the intermediate tilt angle by $\gamma(=(\alpha+\beta)/2)$ with respect to the line of axis A—A of said rotational shaft, said support shaft is provided on a side wall of said casing at a position located on a line drawn through the pivoting point of said center shaft at an angle of $\gamma$ with the line of axis A—A of said rotational shaft, and deviated from the pivoting point of said center shaft toward the valve plate.

3. A variable displacement bent axis type hydraulic machine as defined in claim 1, wherein said rocking lever is formed with a slot at said other end thereof to receive therein a support pin provided at one side of said valve plate.

* * * * *